US009734734B2

(12) United States Patent
Lyon

(10) Patent No.: US 9,734,734 B2
(45) Date of Patent: Aug. 15, 2017

(54) SELF-ERECTABLE DISPLAYS AND METHODS OF MAKING SUCH SELF-ERECTABLE DISPLAYS

(71) Applicant: R.R. Donnelley & Sons Company, Chicago, IL (US)

(72) Inventor: Jon Lyon, Joliet, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 14/711,739

(22) Filed: May 13, 2015

(65) Prior Publication Data

US 2016/0335935 A1 Nov. 17, 2016

(51) Int. Cl.
*G09F 15/00* (2006.01)
*G09F 1/06* (2006.01)

(52) U.S. Cl.
CPC ..... *G09F 1/065* (2013.01)

(58) Field of Classification Search
CPC ..... G09F 15/0062; G09F 15/0056; G09F 15/0031
USPC ..... 40/124.08, 124.14
See application file for complete search history.

(56) References Cited

U.S. PATENT DOCUMENTS 822,841 A 6/1906 Hill
956,916 A 5/1910 Wiederseim, Jr.
1,028,147 A 6/1912 Stranders
1,545,771 A 7/1925 Hout
1,576,672 A 3/1926 Miller
1,656,341 A 1/1928 Smith
1,670,464 A 5/1928 Marsh
1,687,616 A 10/1928 Huye
1,902,566 A 3/1933 Marsh
2,108,349 A 2/1938 Rasmussen
2,113,288 A 4/1938 Berger
2,142,826 A * 1/1939 Rosello ..... G09F 1/14 206/102
2,153,460 A 4/1939 Giles
(Continued)

FOREIGN PATENT DOCUMENTS

CN 203192354 9/2013
DE 2658506 1/1978
(Continued)

OTHER PUBLICATIONS

United States Patent and Trademark Office, "Non-Final Office Action," issued in connection with U.S. Appl. No. 14/709,266, mailed on May 23, 2016, 32 pages.
(Continued)

*Primary Examiner* — Joanne Silbermann
(74) *Attorney, Agent, or Firm* — Hanley, Flight & Zimmerman, LLC

(57) ABSTRACT

Self-erectable displays and methods of making such self-erectable displays are disclosed. An example self-erectable display includes a shroud including a first shroud panel opposite a second shroud panel and a support coupled within the shroud. In the example display, the support including a top edge, a bottom edge, and first and second side edges. The first and second edges extend through an aperture defined by the support. The example display also includes an elastic band coupled to the support to outwardly bias first shroud panel from the second shroud panel.

21 Claims, 10 Drawing Sheets

(56) References Cited

U.S. PATENT DOCUMENTS

| | | | |
|---|---|---|---|
| 2,210,317 | A | 8/1940 | Dueringer |
| 2,283,406 | A | 5/1942 | Bacon |
| 2,290,144 | A | 7/1942 | Katz |
| 2,404,089 | A | 7/1946 | Pollock |
| 2,601,374 | A | 6/1952 | Ditzler et al. |
| 2,637,924 | A | 5/1953 | Hutt |
| 2,728,461 | A | 12/1955 | Paige |
| 2,773,324 | A | 12/1956 | Drueck, Jr. |
| 2,833,074 | A | 5/1958 | Jannes |
| 2,892,276 | A | 6/1959 | Nelson |
| 2,918,178 | A | 12/1959 | Leone |
| 2,984,920 | A | 5/1961 | Acosta et al. |
| 3,015,898 | A | 1/1962 | Keeslar |
| 3,091,877 | A | 6/1963 | Luchsinger |
| 3,234,682 | A | 2/1966 | Frankl |
| 3,267,597 | A | 8/1966 | Jannes |
| 3,302,321 | A | 2/1967 | Walker |
| 3,571,958 | A | 3/1971 | Stevens et al. |
| 3,665,669 | A | 5/1972 | Huber |
| 3,666,607 | A | 5/1972 | Weissman |
| 4,234,148 | A | 11/1980 | Maddestra et al. |
| 4,610,363 | A | 9/1986 | Flum et al. |
| 4,619,426 | A | 10/1986 | Drueck, Jr. |
| 4,750,283 | A | 6/1988 | Halpern |
| 4,770,379 | A | 9/1988 | Estvold |
| 4,773,622 | A | 9/1988 | Herlin |
| 4,774,780 | A | 10/1988 | Crowell |
| 4,790,714 | A | 12/1988 | Schnapp |
| 4,854,060 | A | 8/1989 | Corbo et al. |
| 4,940,199 | A | 7/1990 | Hall |
| 4,984,848 | A | 1/1991 | Scalisi et al. |
| 4,993,846 | A | 2/1991 | Diamond et al. |
| 5,000,717 | A | 3/1991 | Pfeiffer |
| 5,193,466 | A | 3/1993 | Eder |
| 5,197,631 | A | 3/1993 | Mishima |
| 5,297,677 | A | 3/1994 | Burian et al. |
| 5,416,997 | A | 5/1995 | Dyment et al. |
| 5,454,180 | A | 10/1995 | Volpe |
| 5,467,547 | A | 11/1995 | Fortner |
| 5,632,390 | A | 5/1997 | Podergois |
| 5,752,649 | A | 5/1998 | Weder |
| 5,758,438 | A | 6/1998 | Crowell |
| 5,778,959 | A | 7/1998 | Guetschow |
| 5,787,621 | A | 8/1998 | Leksell |
| 5,809,673 | A | 9/1998 | Johnson et al. |
| 5,868,367 | A | 2/1999 | Smith |
| 5,878,945 | A | 3/1999 | Weder |
| 5,937,553 | A | 8/1999 | Maran |
| 5,966,857 | A | 10/1999 | Pettersson et al. |
| 5,983,538 | A | 11/1999 | Crowell |
| 6,311,418 | B1 | 11/2001 | Crowell |
| 6,347,772 | B1 | 2/2002 | L'Hotel |
| 6,497,601 | B1 | 12/2002 | Ward |
| 7,134,230 | B1 | 11/2006 | Boens et al. |
| 7,159,350 | B2 | 1/2007 | L'Hotel |
| 7,234,253 | B2 | 6/2007 | Ossmann |
| 7,437,842 | B2 | 10/2008 | Sgambellone |
| 7,634,865 | B2 | 12/2009 | L'Hotel |
| 7,726,054 | B2 | 6/2010 | Mestres Armengol et al. |
| 7,774,964 | B2 | 8/2010 | L'Hotel |
| 7,980,013 | B2 | 7/2011 | Hsu |
| 8,099,883 | B2 | 1/2012 | Mestres Armengol et al. |
| 8,112,925 | B2 | 2/2012 | Tzuo |
| 8,291,631 | B2 | 10/2012 | Wilder |
| 8,458,939 | B2 | 6/2013 | Arthur et al. |
| 8,590,188 | B2 | 11/2013 | Mirsch |
| 8,701,321 | B2 | 4/2014 | Da Fonseca et al. |
| 8,776,415 | B2 | 7/2014 | Kawaguchi et al. |
| 8,826,833 | B1 | 9/2014 | Fischer et al. |
| 8,863,418 | B2 | 10/2014 | Acker et al. |
| 8,875,908 | B2 | 11/2014 | L'Hotel |
| 9,173,485 | B2 | 11/2015 | Fischer et al. |
| 2004/0111930 | A1 | 6/2004 | Ossmann |
| 2008/0066353 | A1 | 3/2008 | Mills |
| 2008/0083146 | A1 | 4/2008 | Martin Presa |
| 2010/0072330 | A1 | 3/2010 | Tzuo |
| 2010/0236117 | A1 | 9/2010 | Mestres Armengol et al. |
| 2011/0088300 | A1 | 4/2011 | Martin Presa |
| 2012/0227297 | A1 | 9/2012 | Kawaguchi et al. |
| 2013/0219760 | A1 | 8/2013 | Acker et al. |
| 2014/0265777 | A1 | 9/2014 | Fischer et al. |
| 2016/0335925 | A1 | 11/2016 | Ruhaak |
| 2016/0335934 | A1 | 11/2016 | Lyon |

FOREIGN PATENT DOCUMENTS

| | | | | |
|---|---|---|---|---|
| DE | 4005925 | | 10/1991 | |
| DE | 4314654 | | 11/1994 | |
| DE | 9320993 | | 8/1995 | |
| DE | 202010015312 | | 1/2011 | |
| DE | 202011002980 | U1 * | 4/2011 | ..... G09F 1/06 |
| DE | 202014106297 | | 3/2015 | |
| DK | 9500055 | | 5/1995 | |
| DK | 9500277 | | 9/1995 | |
| EP | 1741368 | | 1/2007 | |
| EP | 1830334 | | 9/2007 | |
| EP | 1926076 | | 5/2008 | |
| EP | 2290637 | | 3/2011 | |
| EP | 2400477 | | 12/2011 | |
| ES | 2212927 | | 8/2004 | |
| ES | 2255857 | | 7/2006 | |
| FR | 1254983 | | 3/1961 | |
| FR | 2210317 | | 7/1974 | |
| FR | 2232259 | | 12/1974 | |
| FR | 2233912 | | 1/1975 | |
| FR | 2571949 | | 4/1986 | |
| FR | 2574968 | | 6/1986 | |
| FR | 2650907 | | 2/1991 | |
| FR | 2680030 | | 2/1993 | |
| FR | 2691621 | | 12/1993 | |
| FR | 2730148 | | 8/1996 | |
| FR | 2735264 | | 12/1996 | |
| FR | 2745109 | | 8/1997 | |
| FR | 2760801 | | 9/1998 | |
| FR | 2760802 | | 9/1998 | |
| FR | 2760880 | | 9/1998 | |
| FR | 2770320 | | 4/1999 | |
| FR | 2911425 | | 7/2008 | |
| FR | 2925203 | | 6/2009 | |
| FR | 2925204 | A1 * | 6/2009 | ..... G09F 1/06 |
| FR | 2948222 | | 1/2011 | |
| GB | 463574 | | 4/1937 | |
| GB | 740577 | | 11/1955 | |
| GB | 743378 | | 1/1956 | |
| GB | 824004 | | 11/1959 | |
| GB | 1034280 | | 6/1966 | |
| GB | 1272187 | | 4/1972 | |
| GB | 1317155 | | 5/1973 | |
| WO | 9634379 | | 10/1996 | |
| WO | 9936900 | | 7/1999 | |
| WO | 02095719 | | 11/2002 | |
| WO | 2004044867 | | 5/2004 | |
| WO | 2006040438 | | 4/2006 | |
| WO | 2006067252 | | 6/2006 | |
| WO | 2007138083 | | 12/2007 | |
| WO | 2008049176 | | 5/2008 | |
| WO | 2010019086 | | 2/2010 | |
| WO | 2010130485 | | 11/2010 | |
| WO | 2011092209 | | 8/2011 | |
| WO | 2011113123 | | 9/2011 | |
| WO | 2012061375 | | 5/2012 | |
| WO | 2016057067 | | 4/2016 | |

OTHER PUBLICATIONS

International Searching Authority, "International Search Report and Written Opinion," issued in connection with International Patent Application No. PCT/US2016/064478, mailed on Jan. 24, 2017, 15 pages.

United States Patent and Trademark Office, "Non-Final Office Action," issued in connection with U.S. Appl. No. 14/709,285, mailed on Sep. 15, 2016, 38 pages.

(56) References Cited

OTHER PUBLICATIONS

United States Patent and Trademark Office, "Notice of Allowance," issued in connection with U.S. Appl. No. 14/709,266, mailed on Sep. 26, 2016, 31 pages.
United States Patent and Trademark Office, "Non-Final Office Action," issued in connection with U.S. Appl. No. 15/229,920, mailed on Dec. 1, 2016, 9 pages.
United States Patent and Trademark Office, "Office Action," issued in connection with U.S. Appl. No. 14/709,285, on Mar. 15, 2017, 24 pages.
United States Patent and Trademark Office, "Notice of Allowance," issued in connection with U.S. Appl. No. 15/229,920, on Mar. 22, 2017, 43 pages.
United States Patent and Trademark Office, "Non-final Office Action," issued in connection with U.S. Appl. No. 14/988,616, mailed on Apr. 11, 2017, 36 pages.
United States Patent and Trademark Office, "Notice of Allowance," issued in connection with U.S. Appl. No. 14/709,266, mailed on Apr. 12, 2017, 17 pages.

* cited by examiner

SELF-ERECTABLE DISPLAYS AND METHODS OF MAKING SUCH SELF-ERECTABLE DISPLAYS

FIELD OF THE DISCLOSURE

This disclosure relates generally to displays and, more particularly, to self-erectable displays and methods of making such self-erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
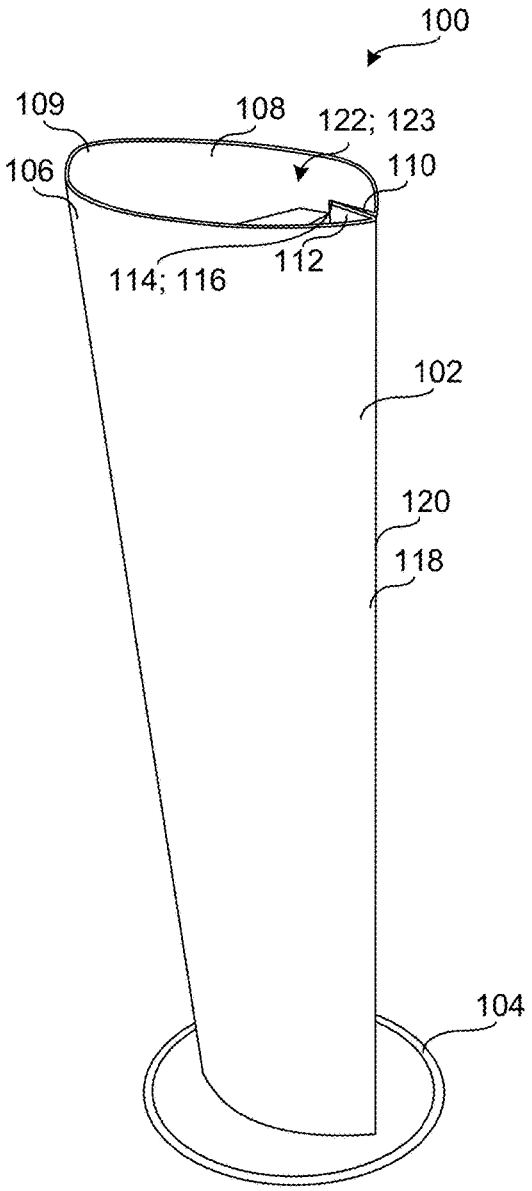
FIG. 1 is a perspective view of an example self-erectable display in accordance with the teachings of this disclosure.

The examples disclosed herein relate to self-erectable displays that can be used for point-of-sale advertising, providing information, or for other suitable purposes. In some examples, the example self-erectable displays may be shipped to a customer in a folded, flat state. The example displays may include a biased support that is in a state of tension when the display is in the folded, flat state because forces imparted by the folded material of the display is greater than a force exerted by the biased support. However, when the display is unfolded, the force being imparted on the biased support is less than the force exerted by the biased support, thereby enabling the biased support to urge the display from the folded position to the erected position.

Thus, using the examples disclosed herein, an individual can erect the example displays with little if any instruction and/or training.

In some examples disclosed herein, the example self-erectable displays include an elongate, tubular shroud into which an internal structure is disposed. In some examples, the shroud includes an oblong cross-section having an example base coupled at an end and the internal structure includes an example biased support(s) coupled within the shroud. In some examples, the cross-section may be another shape including, for example, triangular, square, diamond, circular, or other semi-circular, elliptical, polygonal and/or non-polygonal shape(s).

In some examples, the example shroud is formed of an elongate substrate having top and bottom edges and first and second side edges. To enable the example self-erectable display to be folded for shipping and/or storage, in some examples, longitudinal lines of weakness and transverse lines of weakness are defined in the shroud. The longitudinal lines of weakness may enable the example self-erectable display to be folded relatively flat and the transverse lines of weakness may enable the example self-erectable display to be folded about itself to form a z-fold, for example.

In some examples, the longitudinal and transverse lines of weakness define central panels and outwardly facing flaps. To form the tubular-shaped shroud, the shroud is folded about a central line of weakness and the flaps are inwardly folded and coupled to enable the shroud to have an oblong cross-section and/or to define an aperture or interior space. In some examples, to enable the shroud to be more easily folded about itself, notches are defined between the flaps.

In some examples, the example support is formed of a substrate having top and bottom edges and first and second side edges. To enable the example support to be formed and/or to enable the support to be folded relatively flat within the example shroud for shipping and/or storage, in some examples, lines of weakness are formed in the support to define four relatively larger panels, two relatively smaller panels and two panels including a tongue(s). In some examples, the panels with the tongues are disposed on opposing ends of the support adjacent a larger panel. In some examples, a smaller support panel is spaced from a central axis of the support between two larger panels. In some examples, the larger panels are disposed on either side of the central axis of the substrate. In some examples, the support is symmetric across the central line of weakness. To enable an elastic band to be more easily coupled to the support, in some examples, notches and/or keyed apertures are formed between the larger panels that receive the elastic band. In some examples, the elastic band may be another suitable biasing member.

To form the tubular-shaped support, in some examples, the support is folded about the lines of weakness and the tongues on the ends of the support are inserted through an aperture defined along the central axis of the support. In some examples, the tongues are sized to protrude through the aperture when the substrate is in a flat and/or folded state. After the tongues are protruding through the aperture, to outwardly bias the smaller support panels, in some examples, an elastic band is disposed about the support and within the notches and/or apertures such that at least a portion of the elastic band is disposed relatively parallel to the lines of weakness of the support. In some examples, the tubular support is symmetric or substantially symmetric.

To form the self-erectable display, the example tubular support is coupled within the example tubular shroud. In some examples, the smaller support panels are directly coupled to the shroud panels such that the tongues face the flaps or the central lines of weakness of the shroud. When the support is coupled within the tubular-shaped shroud, the shroud panels are outwardly biased by the smaller support panels via the elastic band. However, if the smaller support panels are moved toward one another against the biasing force of the elastic band, the tongue is withdrawn from and/or moved relative to the aperture to enable the shroud panels to move toward one another and be disposed immediately adjacent one another. When the shroud panels are disposed adjacent one another, the shroud may be folded about itself along the transverse lines of weakness to enable the display to be stored and/or shipped. Thus, the examples disclosed herein enable a display to be folded flat for storage and to later self-erect into a tubular shape.

FIG. 1 illustrates an example self-erectable display 100 including a tubular-shaped shroud 102 coupled to a base 104. In other examples, the example self-erectable display 100 may not include the base 104 such that the shroud 102 is used as an upright display without the base 104.

In this example, the shroud 102 includes opposing first and second shroud panels 106, 108 that are separated by a central line of weakness 109 and flaps 110, 112 adjacent side edges 114, 116 of the shroud 102. In this example, the flaps 110, 112 are coupled together to enclose the shroud 102 and to enable adjacent longitudinal lines of weakness 118, 120 to define an outward facing end of the tubular-shaped shroud 102 opposite the central line of weakness 109 that defines another outward facing end of the shroud 102. To enable the display 100 to be self-erecting, example first and second biased supports 122, 123 are disposed within the example shroud 102.

Figure 2:
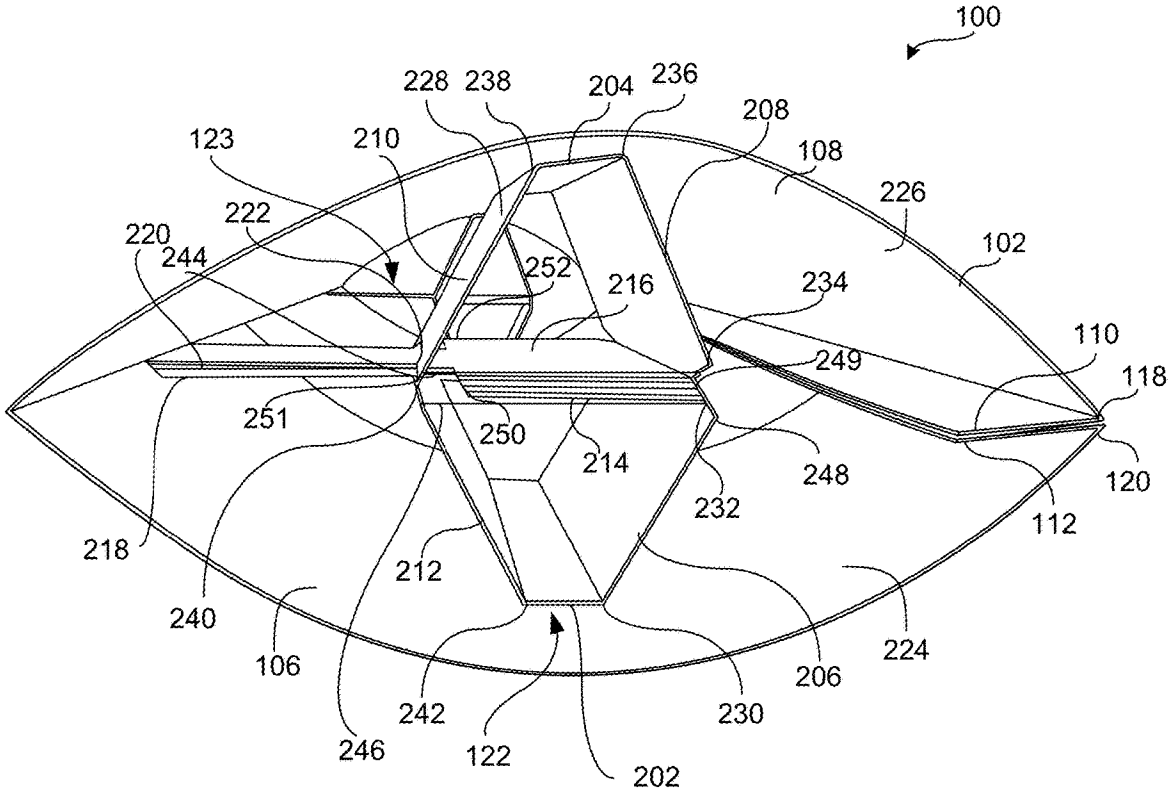
FIG. 2 is a top view of the self-erectable display of FIG. 1.

FIG. 2 shows a top view of the example self-erectable display 100 that illustrates the biased supports 122, 123 coupled within the shroud 102. In this example, the supports 122, 123 are the same or substantially the same size and/or shape. Referring to the first biased support 122, in this example, the first biased support 122 includes a first support panel 202, a second support panel 204, a third support panel 206, a fourth support panel 208, a fifth support panel 210, a sixth support panel 212, a seventh support panel 214, and an eighth support panel 216. The example first biased support 112 also includes tongues 218, 220 protruding through an aperture 222. As shown in the example of FIG. 2, the first support panel 202 is coupled to an internal surface 224 of the first shroud panel 106 and the second support panel 204 is coupled to an internal surface 226 of the second shroud panel 108. In this example, the support 122 is formed using a substrate 228 that includes multiple lines of weakness including a first line of weakness 230, a second line of weakness 232, a third line of weakness 234, a fourth line of weakness 236, a fifth line of weakness 238, a sixth line of weakness 240, and a seventh line of weakness 242. These lines of weakness collectively define the first support panel 202, the second support panel 204, the third support panel 206, the fourth support panel 208, the fifth support panel 210, the sixth support panel 212, the seventh support panel 214, and the eighth support panel 216. To enable elastic bands 244, 246 to be disposed about the support 122, notches 248 are defined between the third support panel 206 and the seventh support panel 214, notches 249 are defined between the fifth support panel 210 and the sixth support panel 212, and notches 251 are defined between the fourth support panel 208 and the eighth support panel 216.

When the substrate 228 is folded about the lines of weakness 230, 232, 234, 236, 238, 240, 242, in this example, the tongues 218, 220 are disposed adjacent one another and positioned through the aperture 256 until a first stop 250 of the seventh support panel 214 and a second stop 252 of the eighth support panel 216 engage portions of the substrate 228 on either side of the aperture 222. After the tongues 218, 220 are disposed through the aperture 222, biasing members such as, for example, the elastic bands 244, 246 are positioned about the support 122 and held in place, in this example, by being disposed within the notches 248, 249, 251 and/or notches on the opposing side of the support 122. The interaction between the elastic band 244, 246 and the substrate 228 urges the second line of weakness 232 and the third line of weakness 234 toward the sixth line of weakness 240, urges the tongues 218, 220 through the aperture 222 and urges the first support panel 202 and the second support panel 204 away from one another.

After the support 122 is formed into a tubular shape (e.g., symmetric tubular shaped support and/or other shape(s) disclosed herein) and the elastic bands 244, 246 are disposed about the substrate 228, the first support panel 202 is coupled to the first shroud panel 106 and the second support panel 204 is coupled to the second shroud panel 108. The first support panel 202 and the second support panel 204 may be coupled to the first shroud panel 106 and the second shroud panel 108, respectively, in any suitable way such as, for example, with adhesive, glue, tape, staples, and/or any other suitable mechanical and/or chemical fastener(s). As shown in the example of FIG. 2, the biasing force imposed by the elastic bands 244, 246 outwardly urges the first support panel 202 and the second support panel 204 and, in turn, outwardly urges the first shroud panel 106 and the second shroud panel 108 to have an oblong cross-section when erected. To flatten the example self-erectable display 100, the first support panel 202, the second support panel 204, the first shroud panel 106, and the second shroud panel 108 are urged toward one another against the biasing force of the elastic bands 244, 246. For example, a user may push the first shroud panel 106 and the second shroud panel 108 together to flatten the display 100.

Figure 3:
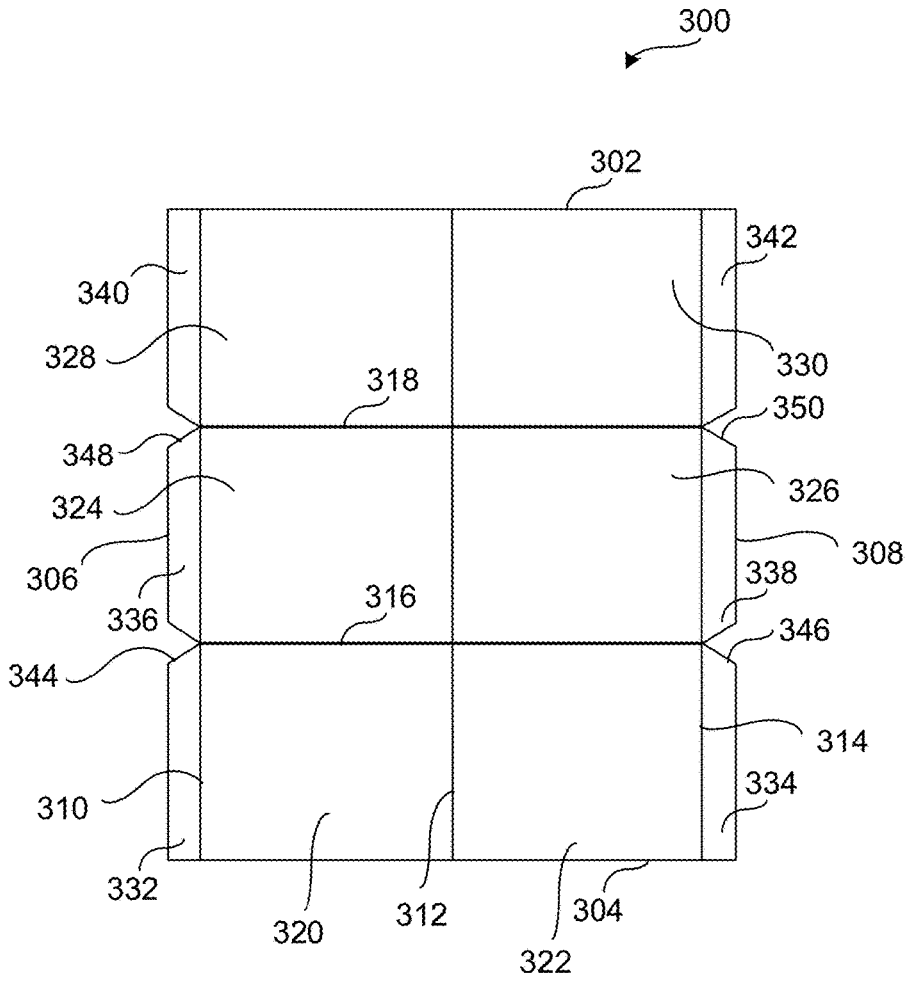
FIG. 3 illustrates a plan view of an example shroud in a flat state that can be used to implement the example self-erectable display of FIG. 1.

FIG. 3 illustrates an example shroud 300 in a flat state that can be used to implement the example self-erectable display 100 of FIG. 1. While the example shroud 300 is shown as being a single piece of substrate, in other examples, the shroud may be more than one piece of substrate that are coupled together to form the example self-erectable display as disclosed herein. In this example, the shroud 300 includes a top edge 302, a bottom edge 304, a first side edge 306, and a second side edge 308. To enable the shroud 300 to be foldable for shipping and/or storage, the shroud 300 defines a first longitudinal line of weakness 310, a second longitudinal line of weakness 312, a third longitudinal line of weakness 314, a first transverse line of weakness 316, and a second transverse line of weakness 318. In this example, the longitudinal lines of weakness 310, 312, 314 are substantially perpendicular relative to the transverse lines of weakness 316, 318. As used herein, substantially perpendicular means between zero to about five degrees from perpendicular and/or accounts for manufacturing tolerances.

In this examples, the longitudinal lines of weakness 310, 312, 314 and the transverse lines of weakness 316, 318 collectively define a first central panel 320, a second central panel 322, a third central panel 324, a fourth central panel 326, a fifth central panel 328, a sixth central panel 330, a first flap 332, a second flap 334, a third flap 336, a fourth flap 338, a fifth flap 340, and a sixth flap 342. As shown in the example of FIG. 3, notches 344, 346, 348, 350 are defined by the shroud 300 between the flaps 332, 334, 336, 338, 340, 342.

To form the tubular-shaped shroud 300, the shroud 300 is folded about the second line of weakness 312 and the flaps 332, 334, 336, 338, 340, 342 are inwardly folded about the first lines of weakness 310 and the third line of weakness 314 to enable the opposing flaps (i.e., first flap 332 and second flap 334, third flap 336 and fourth flap 338, and fifth flap 340 and sixth flap 342) to be coupled to one another and disposed within an interior of the shroud 300. The flaps comprising the opposing flap pairs may be coupled in any suitable way using, for example, adhesive, glue, tape, staples, and/or any suitable mechanical and/or chemical fastener(s). After the opposing flap pairs are formed, the shroud 300 may be folded (e.g., a z-fold or a c-fold) about the axes formed by the transverse lines of weakness 316, 318 for shipping and/or storage. In some examples, the notches 344, 346, 348, 350 may more easily enable the shroud 300 to be folded about the transverse lines of weakness 316, 318.

Figure 4:
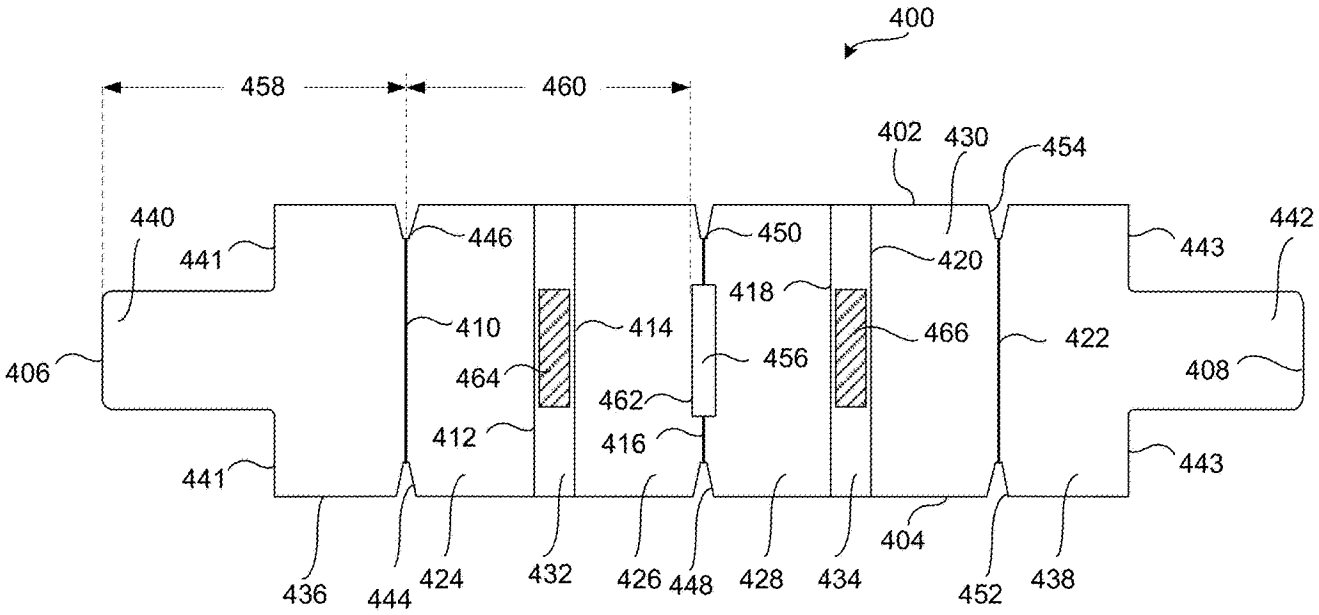
FIG. 4 illustrates a plan view of an example support in a flat state that can be used to implement the example self-erectable display of FIG. 1.

FIG. 4 illustrates an example support and/or insert 400 in a flat state that can be used to implement the example self-erectable display 100 of FIG. 1. In this example, the support 400 includes a top edge 402, a bottom edge 404, a first side edge 406, and a second side edge 408. To enable the example support 400 to be formed and/or to enable the support 400 to be folded flat within the example shroud 300 for shipping and/or storage, in some examples, a plurality of lines of weakness are formed in the support 400 to define a plurality of panels and tongues. Specifically, in this example, the support 400 includes a first line of weakness 410, a second line of weakness 412, a third line of weakness 414, a fourth line of weakness 416, a fifth line of weakness 418, a sixth line of weakness 420, and a seventh line of weakness 422 that collectively form a first main panel 424, a second main panel 426, a third main panel 428, a fourth main panel 430, a first intermediate panel 432, a second intermediate panel 434, a first end panel 436, and a second end panel 438. In this example, the main panels are shown larger than the relatively smaller intermediate panels, in terms of width. Other dimensions may be used in other examples. Also, in this example, the first end panel 436 includes a first tongue 440 and first stops 441, and the second end panel 438 includes a second tongue 442 and second stops 443. The lines of weakness 410, 412, 414, 416, 418, 419, 420, 422 may be similar or different. For example, while other examples exist, one or more of the lines of weakness 410, 412, 414, 416, 418, 419, 420, 422 may be perforations and one or more of the lines of weakness 410, 412, 414, 416, 418, 419, 420, 422 may be creases or folds. In some examples, the first intermediate panel 432 is positioned between the first main panel 424 and the second main panel 426, and the second intermediate panel 434 is positioned between the third main panel 428 and the fourth main panel 430. In this example, the first end panel 436 is positioned immediately adjacent the first main panel 424, and the second end panel 438 is positioned immediately adjacent the fourth main panel 430.

To enable an elastic band to be coupled to and more easily retained about the support 400, in this example, notches 444, 446 are formed between the first end panel 436 and the first main panel 424, notches 448, 450 are formed between the second main panel 426 and the third main panel 428, and notches 452, 454 are formed between the fourth main panel 430 and the second end panel 438. In this example, the notches 444, 446 are v-shaped and oppose one another, the notches 448, 450 are v-shaped and oppose one another and the notches 452, 454 are v-shaped and oppose one another. In other examples, one or more of the notches 444, 446, 448, 450, 452, 454 may be differently shaped and/or the support 400 may define more or less notches than shown in this example. For example, the notches may be key shaped and/or any other shape that may enable an elastic band to be retained in place. Also, in some examples, apertures (see FIG. 7) through which the elastic member is threaded may be used in addition to or alternatively to the notches 444, 446, 448, 450, 452, 454.

To form the tubular-shaped support 400, in some examples, the support 400 is folded about the lines of weakness 410, 414, 416, 418, 419, 420, 422 and the first tongue 440 and second tongue 442 of the support 400 are brought together toward and through an aperture 456. In the illustrated example of FIG. 4, to enable the first tongue 440 and second tongue 442 to extend through the aperture 456 when the support 400 is in the folded position, a first distance 458 between the first side edge 406 and the first line of weakness 410 is greater than a second distance 460 between the first line of weakness 410 and an edge 462 defining the aperture 456. In some examples, once the first tongue 440 and the second tongue 442 are inserted through the aperture 456, the first end panel 436 and the second end panel 438 are further coupled using, for example, adhesive, glue, tape, a staple(s), and/or any suitable mechanical and/or chemical fastener(s). However, in some examples, there is no adhesive or other additional coupling or fastener used to couple the first end panel 436 to the second end panel 438 and/or to couple the first and second tongues 440, 442. In such examples, the first and second tongues 440, 442 penetrate the aperture 456 in the opened and/or flattened condition so no adhesive or other fastener is needed to hold the tongues 440, 442 together. In other words, because the first distance 458 is longer than the second distance 460, when the support 400 is flattened, the tongues 440, 442 remain in aperture 456. Had the first distance 458 been shorter than the second distance 460, the tongues 440, 442 would have separated from each other and/or possibly got bound up preventing the tongues 440, 442 from protruding through the aperture 456 when the display 100 is expanded. Maintaining the tongues 440, 442 within the aperture keeps the tongues 440, 442 together, and no glue and/or other fastener is needed, saving an extra assembly step. In addition, in some examples, the first distance 458 is just greater than the second distance 460 as opposed to being significantly greater. If the first distance 458 were significantly longer than the second distance 460, the tongues 440, 442 would have to be severely bent and/or damaged when being routed and/or positioned through the aperture 456, which would compromise the integrity of the structure.

To outwardly bias the first intermediate panel 323 and the second intermediate panel 434, after the first tongue 440 and second tongue 442 are received in the aperture 456, one or more elastic band(s) is disposed about the support 400 and within the notches 444, 446, 448, 450, 452, 454. In this example, portions of the elastic band(s) are disposed relatively parallel to the first line of weakness 410 and the seventh line of weakness 422 that separate the first end panel 436 and the second end panel 438. The first main panel 424 and the fourth main panel 430 and portions of the elastic band(s) extend between the first line of weakness 410, the third line of weakness 416, and the seventh line of weakness 422 and/or the interior of the support. As used herein, substantially parallel means between about zero to five degrees of parallel and/or accounts for manufacturing tolerances. To enable the support 400 to be coupled to the opposing shroud panels 106, 108, a first fastener, adhesive and/or tape 464 is positioned on an outward facing surface of the first second intermediate panel 432 and a second fastener, adhesive and/or tape (e.g., two-sided tape) 466 is positioned on an outward facing surface of the second intermediate panel 434.

Figure 5:
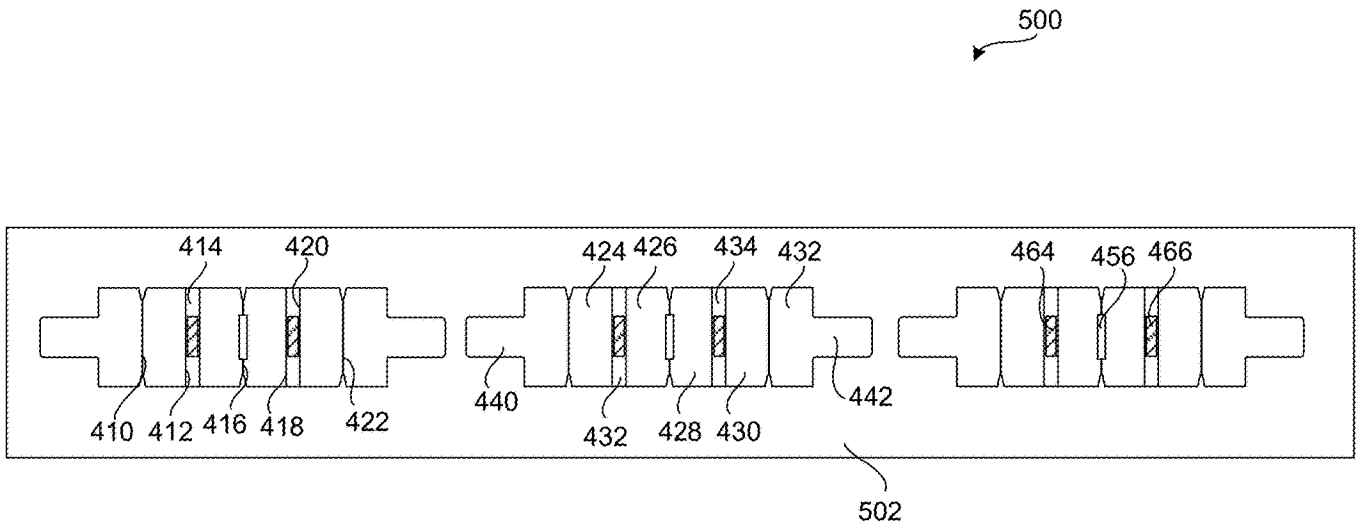
FIG. 5 illustrates a plan view of an example web including a plurality of example supports that can be used to implement the examples disclosed herein.

FIG. 5 illustrates an example web 500 including the supports 400 that can be used to implement the examples disclosed herein. In practice, in some examples, each of the supports 400 may be die cut from a waste matrix 502 surrounding the supports 400 prior to forming the tubular support.

Figure 6:
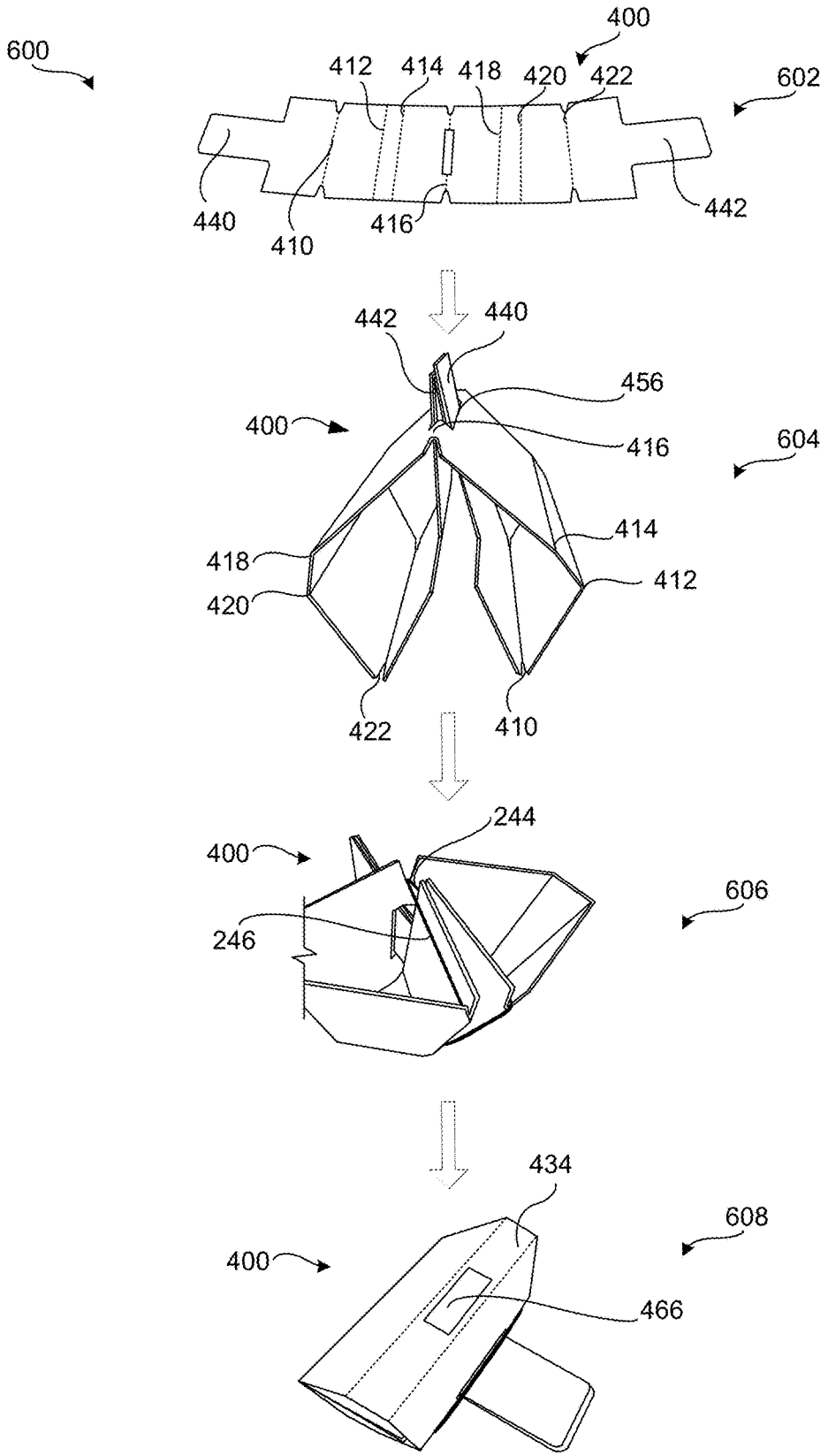
FIG. 6 illustrates an example flow diagram including processes of forming an example support that can used to implement the example self-erectable display of FIG. 1.

FIG. 6 is an example flow diagram 600 that illustrates example processes of assembling the example support 400. Reference number 602 illustrates the example support 400 in a flat or non-tubular state. At reference number 604, the support 400 is being folded about the lines of weakness 410, 412, 414, 416, 418, 420, 422 and the first tongue 440 and the second tongue 442 are being positioned through the aperture 456.

At reference number 606, to urge the first tongue 440 and the second tongue 442 through the aperture 456, the elastic bands 244, 246 are disposed about the support 400 and within the notches 444, 446, 448, 450, 452, 454. In this example, the elastic bands 244, 246 are disposed relatively parallel relative to the first lines of weakness 410, the third line of weakness 416, and the seventh line of weakness 422. At block 608, the first fastener 464 and the second fastener 466 (e.g., double sided tape) are coupled to the outwardly facing surfaces of respective first intermediate panel 432 and second intermediate panel 434.

Figure 7:
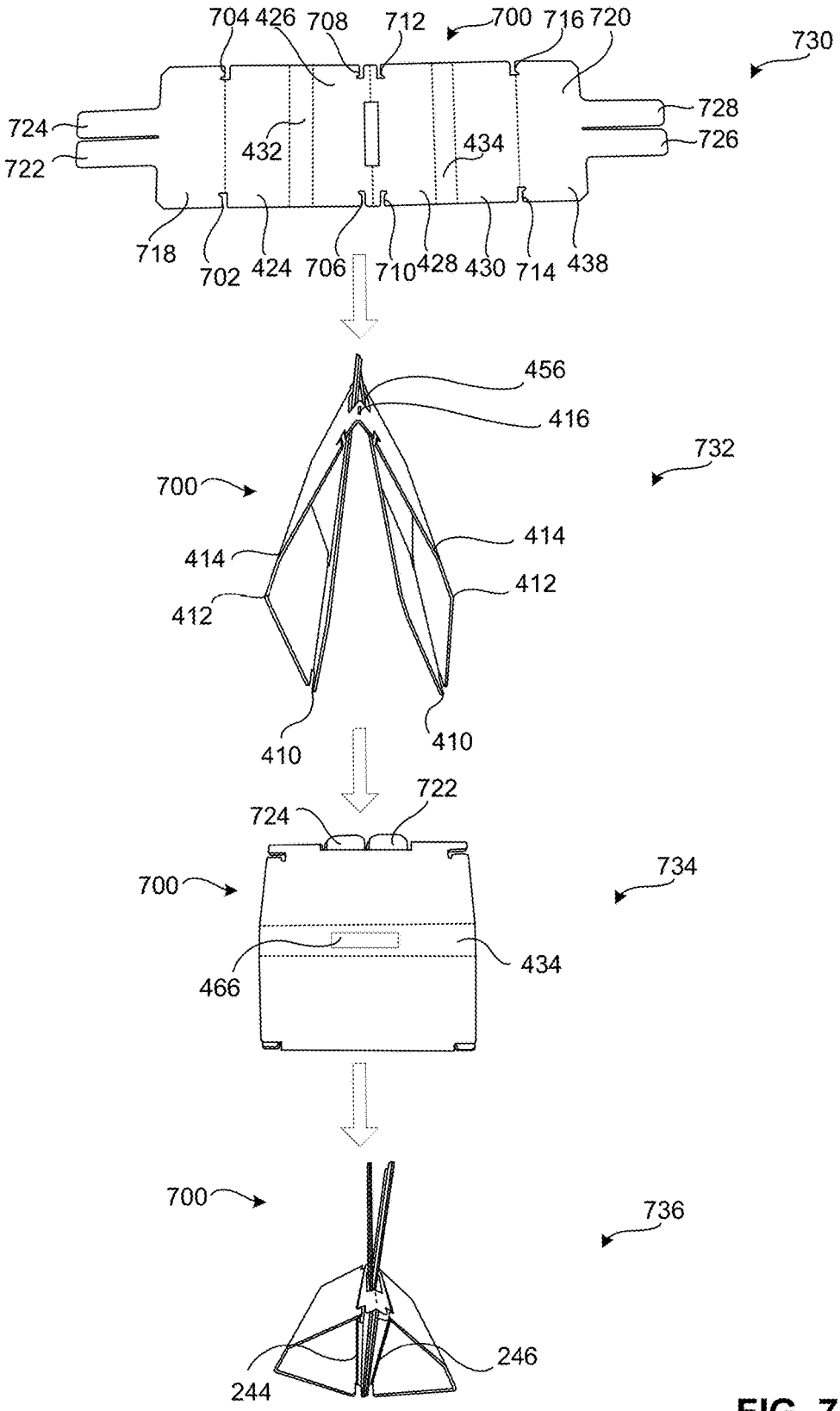
FIG. 7 illustrates an alternative example flow diagram including processes of forming an alternative example support that can used to implement the example self-erectable display of FIG. 1.

FIG. 7 is an example flow diagram 700 that illustrates example processes of assembling an example support 700. The example support 700 is substantially similar to the example support 400. However, in contrast to the example support 400, the example support 700 includes different example notches and/or apertures to retain the biasing member(s) (e.g., elastic band(s)). Specifically, the example support 700 includes a first key shaped notch 702, a second key shaped notch 704, a third key shaped notch 706, a fourth key shaped notch 708, a fifth key shaped notch 710, a sixth key shaped notch 712, a seventh key shaped notch 714, and an eighth key shaped notch 716. Additionally, in contrast to the example support 400, the example support 700 includes different example tongues. For example, a first end panel 718 includes a first tongue 722 and a second tongue 724, and a second end panel 720 includes a third tongue 726 and a fourth tongue 728.

Referring to reference number 730, the example support 700 is illustrated in a flat or non-tubular state. At reference number 732, the support 700 is being folded about the lines of weakness 410, 412, 414, 416, 418, 420, 422 and the tongues 722, 724, 726, 728 are being positioned through the aperture 456. At reference number 734, the fasteners 464, 466 (e.g., double sided tape) are coupled to the outwardly facing surfaces of the intermediate panels 432, 434. At block 736, to urge the tongues 722, 724, 726, 728 through the aperture 456, the elastic bands 244, 246 are disposed about the support 400, and within the notches 702, 704, 706, 706, 708, 710, 712, 714, 716. In this example, the elastic bands 244, 246 are disposed relatively parallel relative to the first line of weakness 410, the third line of weakness 416, and the seventh line of weakness 422.

Figure 8:
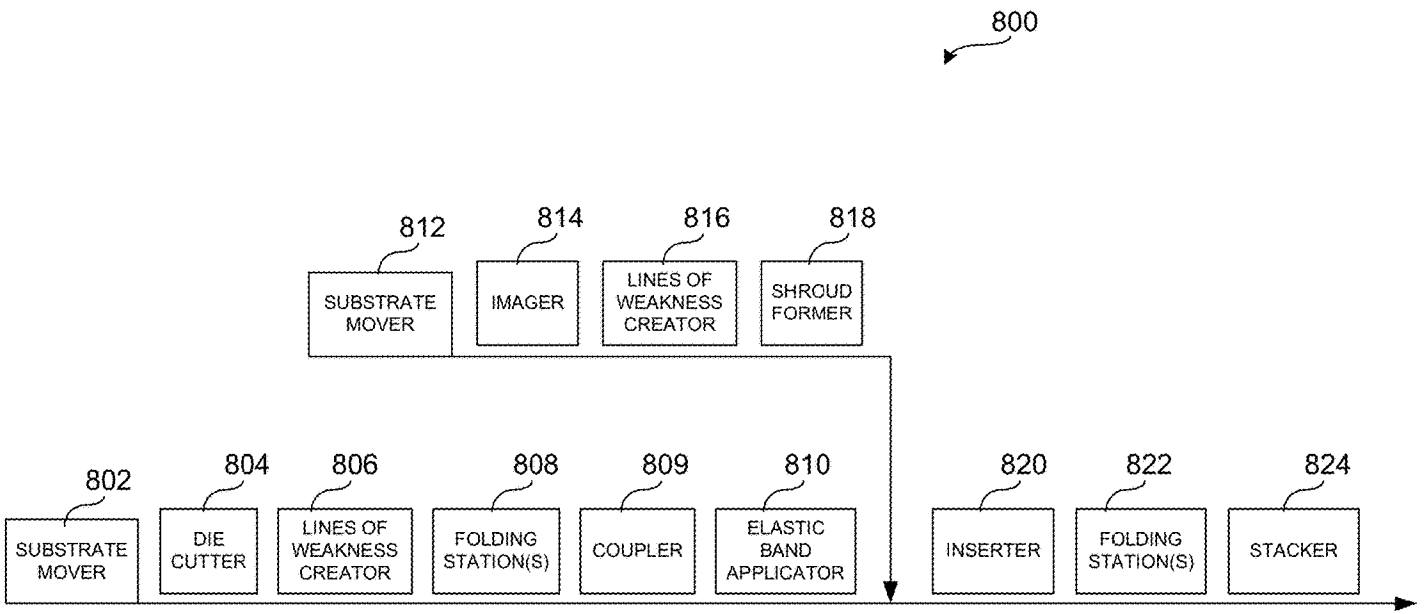
FIG. 8 illustrates an example apparatus that can be used to produce the example self-erectable displays disclosed herein.

FIG. 8 represents an example apparatus 800 that can be used to produce the example self-erectable displays disclosed herein. In some examples, the apparatus 800 performs an in-line process that includes processes to produce an example support in accordance with the teachings of this disclosure, processes to produce an example shroud in accordance with the teachings of this disclosure and processes to produce an example self-erectable display in accordance with the teachings of this disclosure. While the processes disclosed below are described in connection with automatic processes, any and/or all of the processes disclosed may instead be implemented manually.

In this example, the example apparatus 800 includes elements to produce the example support including, for example, a substrate mover 802, a die cutter 804, a lines of weakness creator 806, a folding station 808, a coupler 809 and an elastic band applicator 810. In this example, the example apparatus 800 also includes elements to produce the example shroud including, for example, a substrate mover 812, an imager 814, a lines of weakness creator 816 and a shroud former 818. In this example, the apparatus 800 also includes elements to produce the example self-erectable display including, for example, an inserter 820, a folding station 822 and a stacker 824.

To produce an example support in accordance with the teachings of this disclosure, in some examples, the substrate mover 802 feeds one or more pieces of substrate and/or a web of substrate into the apparatus 800. The die cutter 804 die cuts the substrate to form a support blank and a waste matrix, and the lines of weakness creator 806 forms one or more lines of weakness on first and/or second sides of the support blank using a die(s), a cutting tool(s), a scoring tool(s), a slotting tool(s), etc. The folding station 808 folds the support blank along one or more of the lines of weakness to form a tubular support. The coupler 809 couples the ends of the support together by, for example, inserting tongues on ends of the support through an aperture adjacent a central axis of the support. In some examples, the coupler 809 applies a fastener such as, for example, an adhesive, glue and/or tape to one or more of the smaller support panels to enable the tubular support to be coupled within the tubular shroud. The elastic band applicator 810 positions an elastic band about the support within notches (e.g., v-shaped notches, key-shaped notches, etc.) defined by the support. In some examples, the processes implemented by the folding station 808, the coupler 809 and/or the elastic band applicator 810 are performed manually.

To produce an example shroud in accordance with the teachings of this disclosure, in some examples, the substrate mover 812 feeds one or more pieces of substrate and/or a web of substrate into the apparatus 800. In some examples, the imager 814 images a first and/or a second side of the shroud blank. The images may include brand-related images and/or text, advertising-related images and/or text, point-of-purchase-related images and/or text, instructional images and/or text, and/or any other desired indicia. The lines of weakness creator 816 forms one or more lines of weakness on first and/or second sides of the shroud blank using a die(s), a cutting tool(s), a scoring tool(s), a slotting tool(s), etc. In some examples, the shroud former 818 forms a tubular-shaped shroud by folding the shroud about a central line of weakness and coupling inwardly facing flaps. In some examples, the processes implemented by the shroud former 818 is performed manually.

To produce an example self-erectable display in accordance with the teachings of this disclosure, in some examples, the inserter 820 inserts and couples one or more example tubular supports within the example shroud. In some examples, the inserter 820 uses adhesive and/or glue to couple the tubular supports within the example shroud. The folding station 822 flattens and/or folds the self-erectable display about longitudinal axes of the shroud and/or folds the self-erectable display about transverse axes of the shroud for storage and/or shipping. The stacker 824 stacks the self-erectable displays for storage and/or shipping, etc. In some examples, the processes implemented by the inserter 820, the folding station 822 and/or the stacker 824 are performed manually.

While the stations and/or portions including the example substrate mover 802, the example die cutter 804, the example lines of weakness creator 806, the example folding station 808, the example coupler 809, the example elastic band applicator 810, the example substrate mover 812, the example imager 814, the example lines of weakness creator 816, the example shroud former 818, the example inserter 820, the example folding station 822, the example stacker 824 of the apparatus 800 are depicted in a particular order, the stations and/or portions including the example substrate mover 802, the example die cutter 804, the example lines of weakness creator 806, the example folding station 808, the example coupler 809, the example elastic band applicator 810, the example substrate mover 812, the example imager 814, the example lines of weakness creator 816, the example shroud former 818, the example inserter 820, the example folding station 822 and/or the example stacker 824 may be implemented in any other way. For example, the order of the stations and/or portions including the example substrate mover 802, the example die cutter 804, the example lines of weakness creator 806, the example folding station 808, the example coupler 809, the example elastic band applicator 810, the example substrate mover 812, the example imager 814, the example lines of weakness creator 816, the example shroud former 818, the example inserter 820, the example folding station 822 and/or the example stacker 824 may be changed, and/or some of the stations and/or portions including the example substrate mover 802, the example die cutter 804, the example lines of weakness creator 806, the example folding station 808, the example coupler 809, the example elastic band applicator 810, the example substrate mover 812, the example imager 814, the example lines of weakness creator 816, the example shroud former 818, the example inserter 820, the example folding station 822 and/or the example stacker 824 may be changed, eliminated, or combined. For example, while the apparatus 800 is depicted as having a die cutter being separate from a lines of weakness creator, in some examples, the die cutter and the lines of weakness creator may be combined.

Figure 9:
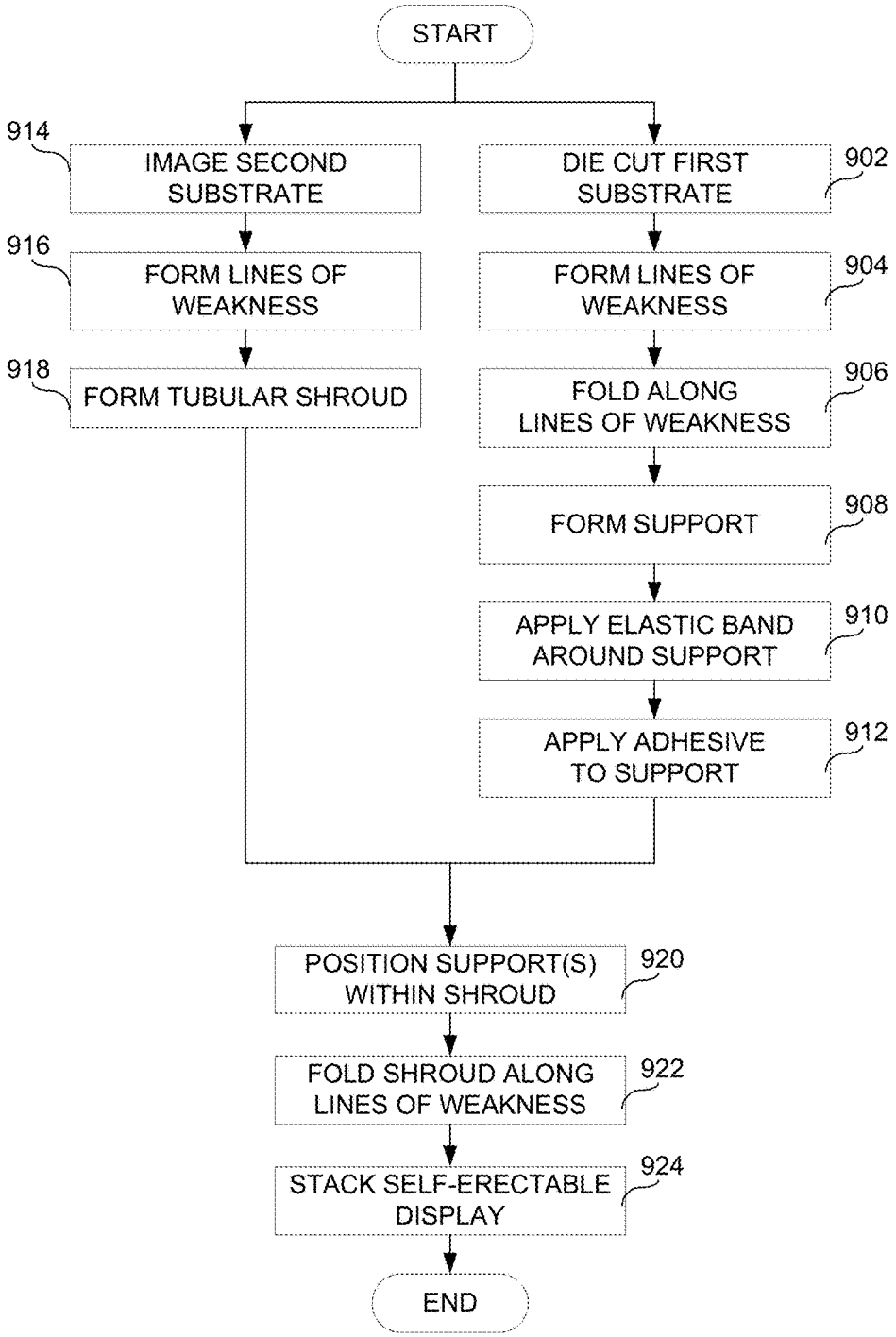
FIG. 9 illustrates a flowchart representative of machine readable instructions that may be executed to implement the apparatus of FIG. 8.

A flowchart representative of example machine readable instructions for implementing the apparatus 800 of FIG. 8 is shown in FIG. 9. In this example, the machine readable instructions comprise a program for execution by a processor such as the processor 1012 shown in the example processor platform 1000 discussed below in connection with FIG. 10. The program may be embodied in software stored on a tangible computer readable storage medium such as a CD-ROM, a floppy disk, a hard drive, a digital versatile disk (DVD), a Blu-ray disk, or a memory associated with the processor 1012, but the entire program and/or parts thereof could alternatively be executed by a device other than the processor 1012 and/or embodied in firmware or dedicated hardware. Further, although the example program is described with reference to the flowchart illustrated in FIG. 9, many other methods of implementing the example apparatus 800 may alternatively be used. For example, the order of execution of the blocks may be changed, and/or some of the blocks described may be changed, eliminated, or combined.

As mentioned above, the example processes of FIG. 9 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 9 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The process of FIG. 9 directed toward producing an example support includes die cutting a first substrate (e.g., the support 400, the support 700) (block 902) using, for example, the die cutter 804 that die cuts one or more pieces of substrate and/or a web of substrate to form a support blank and a waste matrix. Lines of weakness are formed on the support blank (block 904) by, for example, the lines of weakness creator 806 forming one or more lines of weakness on first and/or second sides of the support blank using a die(s), a cutting tool(s), a scoring tool(s), a slotting tool(s), etc. The support blank is folded about the lines of weakness (block 906) using, for example, the folding station 808 that folds the support blank along the lines of weakness to form a tubular support. The tubular support may be substantially symmetric about a transverse and/or longitudinal axis of the support. The support is formed (block 908) using, for example, the coupler 809 that couples the ends of the support together by inserting one or more tongues of the support through an aperture adjacent a central axis of the support. An elastic band(s) is applied around the support (block 910) using, for example, the elastic band applicator 810 that positions the elastic band about the support such that the elastic band extends between top and bottom edges of the support and across an aperture defined by the tubular support. Fastener(s) such as, for example, an adhesive (e.g., double sided tape) is applied to an exterior surface(s) of the support (block 912) using, for example, the coupler 809 that applies adhesive to one or more of the smaller support panels.

The process of FIG. 9 directed toward producing an example shroud includes imaging a second substrate (e.g., the shroud 300) (block 914) using, for example, the imager 814 that images a first and/or second side of the shroud with, for example, brand-related images and/or text, advertising-related images and/or text, point-of-purchase-related images and/or text, instructional images and/or other text, indicia and/or images. Lines of weakness are formed on the shroud blank (block 916) using, for example, the lines of weakness creator 816 that forms one or more lines of weakness on first and/or second sides of the shroud blank using a die(s), a cutting tool(s), a scoring tool(s), a slotting tool(s), etc. The tubular shroud is formed (block 918) using, for example, the shroud former 818 that folds the shroud about a central line of weakness and couples inwardly facing flaps using, for example, adhesive, glue and/or a staple(s).

The process of FIG. 9 directed toward producing an example self-erectable display in accordance with the teachings of this disclosure also includes inserting a support(s) within the shroud (block 920) using, for example, the inserter 820 that inserts and couples the support(s) within the shroud such that outwardly biased support panels expand the opposing shroud panels to enable the shroud to have an oblong cross-section when erected. The self-erectable display is folded along lines of weakness (block 922) using, for example, the folding station 822 that flattens and/or folds the self-erectable display about longitudinal axes of the shroud and/or transverse axes of the shroud for storage and/or shipping. The folded self-erectable display is stacked (block 924) using, for example, the stacker 824 that stacks the self-erectable displays for storage and/or shipping, etc.

Figure 10:
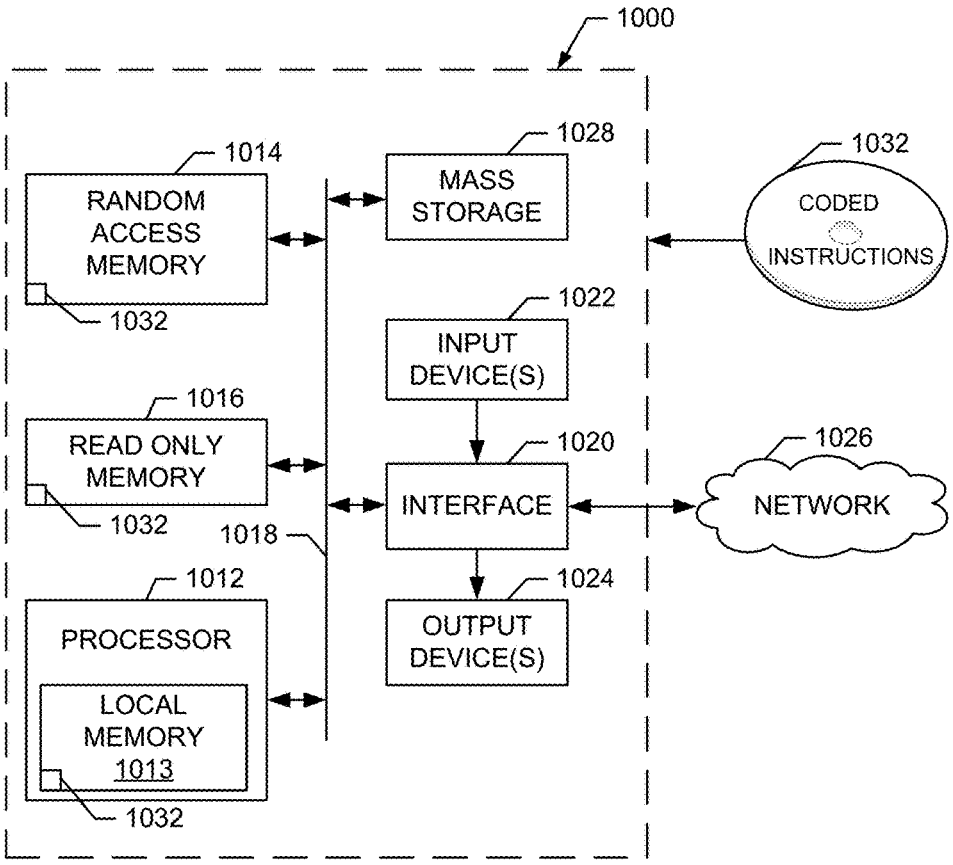
FIG. 10 illustrates a processor platform to execute the instructions of FIG. 9 to implement the apparatus of FIG. 8.

FIG. 10 is a block diagram of an example processor platform 1000 capable of executing the instructions of FIG. 9 to implement the apparatus 800 of FIG. 8. The processor platform 900 can be, for example, a server, a personal computer, a mobile device (e.g., a tablet such as an iPad™), an Internet appliance, a DVD player, a CD player, a digital video recorder, a Blu-ray player, or any other type of computing device.

The processor platform 1000 of the illustrated example includes a processor 1012. The processor 1012 of the illustrated example is hardware. For example, the processor 1012 can be implemented by one or more integrated circuits, logic circuits, microprocessors or controllers from any desired family or manufacturer.

The processor 1012 of the illustrated example includes a local memory 1013 (e.g., a cache). The processor 1012 of the illustrated example is in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), and/or a PCI express interface.

In the illustrated example, one or more input devices 1022 are connected to the interface circuit 1020. The input device(s) 1022 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1020 of the illustrated example, thus, typically includes a graphics driver card, a graphics driver chip or a graphics driver processor.

The interface circuit 1020 of the illustrated example also includes a communication device such as a transmitter, a receiver, a transceiver, a modem and/or network interface card to facilitate exchange of data with external machines (e.g., computing devices of any kind) via a network 1026 (e.g., an Ethernet connection, a digital subscriber line (DSL), a telephone line, coaxial cable, a cellular telephone system, etc.).

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, RAID systems, and digital versatile disk (DVD) drives.

The coded instructions 1032 of FIG. 9 may be stored in the mass storage device 1028, in the volatile memory 1014, in the non-volatile memory 1016, and/or on a removable tangible computer readable storage medium such as a CD or DVD.

As set forth herein, an apparatus includes a shroud including a first shroud panel opposite a second shroud panel; a support coupled within the shroud, the support including a top edge, a bottom edge, and first and second side edges, the first and second edges extending through an aperture defined by the support; and an elastic band to be coupled to the support to outwardly bias the first shroud panel from the second shroud panel. In some examples, the top and bottom edges define notches into which the elastic band is disposed. In some examples, the first edge further includes a first tongue and a first stop and the second edge includes a second tongue and a second stop. In some examples, the first and second stops engage the support adjacent the aperture to restrict further movement of the first and second tongues through the aperture.

In some examples, the support includes first and second support panels, the first support panel to be coupled to the first shroud panel and the second support panel to be coupled to the second shroud panel. In some examples, the apparatus further includes a notch defined by the top edge or the bottom edge into which the elastic band is to be disposed, the notch positioned between the first support panel and the second support panel. In some examples, the shroud further includes a first shroud line of weakness and a second shroud line of weakness, the first shroud line of weakness separating the first shroud panel and the second shroud panel at a first end of the shroud, the second shroud line of weakness separating the first shroud panel and the second shroud panel at a second end of the shroud.

In some examples, the shroud is collapsible to a storage state by urging the first shroud panel toward the second shroud panel against a biasing force of the elastic band. In some examples, the first shroud panel includes a first flap and the second shroud panel includes a second flap coupled to the first flap. In some examples, the first shroud panel includes a first transverse line of weakness and the second shroud panel includes a second transverse line of weakness, the first and second transverse lines of weakness to be immediately adjacent one another when the first and second shroud panels are being collapsed to a storage position. In some examples, the apparatus is a self-erecting display. In some examples, the support is symmetric.

An example apparatus includes a support to be coupled within a self-erecting display, the support including a top edge, a bottom edge, and first and second side edges, the first and second side edges to extend through an aperture defined by the support; and an elastic band to be coupled to the support and outwardly bias the display when the support is coupled therein.

In some examples, the top and bottom edges define notches into which the elastic band is disposed. In some examples, the apparatus further includes a first tongue adjacent the first edge and a second tongue adjacent the second edge, the aperture to receive the first and second tongues to couple the first and second side edges. In some examples, the support includes first and second support panels, the first support panel and the second support panel to be coupled to respective opposing shroud panels. In some examples, the apparatus further includes a notch defined by the top edge or the bottom edge into which the elastic band is to be disposed, the notch positioned between the first support panel and the second support panel.

An example apparatus includes a shroud including a first shroud panel, a second shroud panel coupled to the first shroud panel, and an interior formed between the first shroud panel and the second shroud panel; a support disposed in the interior of the shroud, the support including a top edge, a bottom edge, and first and second side edges, and the first side edge and the second side edge to extend through an aperture defined by the support; and a biasing member coupled to the support to cause a portion of the first shroud panel to separate from a portion of the second shroud panel.

In some examples, the interior has an oblong cross-section. In some examples, the biasing member surrounds the support. In some examples, the biasing member is an elastic band. In some examples, the support is a first support, further including a second support disposed in the interior of the shroud spaced from the first support. In some examples, the first edge includes a first tongue and a first stop and the second edge includes a second tongue and a second stop, the first and second stops to engage the support adjacent the aperture to restrict further movement of the first and second tongues through the aperture.

The examples self-erectable displayed disclosed herein may be deployed from a storage state to an erected or deployed state with little effort. For example, a user such as, for example, a shop clerk, can remove a folded display from an outer packaging or container and unfold the display along the lines of weakness disclosed above. The force imparted by the biasing member(s) on the internal supports, automatically forces the outer shroud panels to expand away from one of other as disclosed above. In other words, as the display is unfolded, the display simply pops open by itself. The deployment of the display is then complete and the display is ready for placement in a desired location and/or coupling to an optional base should additional stability be desired.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a shroud including a first shroud panel opposite a second shroud panel;

a support coupled within the shroud, the support including a top edge, a bottom edge, and first and second side edges, the first and second edges extending through an aperture defined by the support, the first side edge includes a first tongue and a first stop and the second side edge includes a second tongue and a second stop; and an elastic band to be coupled to the support to outwardly bias the first shroud panel from the second shroud panel, when the elastic band is coupled to the support, the elastic band surrounds the support engaging the top edge and the bottom edge.

2. The apparatus of claim 1, wherein the top and bottom edges define notches into which the elastic band is to be disposed.

3. The apparatus of claim 1 wherein the first and second stops engage the support adjacent the aperture to restrict further movement of the first and second tongues through the aperture.

4. The apparatus of claim 1, wherein the support includes first and second support panels, the first support panel to be coupled to the first shroud panel and the second support panel to be coupled to the second shroud panel.

5. The apparatus of claim 4, further including a notch defined by the top edge or the bottom edge into which the elastic band is to be disposed, the notch positioned between the first support panel and the second support panel.

6. The apparatus of claim 4, wherein the first support panel is substantially parallel to the second support panel.

7. The apparatus of claim 1, wherein the shroud further includes a first shroud line of weakness and a second shroud line of weakness, the first shroud line of weakness separating the first shroud panel and the second shroud panel at a first end of the shroud, the second shroud line of weakness separating the first shroud panel and the second shroud panel at a second end of the shroud.

8. The apparatus of claim 7, wherein the shroud is collapsible to a storage state by urging the first shroud panel toward the second shroud panel against a biasing force of the elastic band.

9. The apparatus of claim 1, wherein the first shroud panel includes a first flap and the second shroud panel includes a second flap coupled to the first flap.

10. The apparatus of claim 1, wherein the first shroud panel includes a first transverse line of weakness and the second shroud panel includes a second transverse line of weakness, the first and second transverse lines of weakness to be immediately adjacent one another when the first and second shroud panels are being collapsed to a storage position.

11. The apparatus of claim 1, wherein the apparatus is a self-erecting display.

12. The apparatus of claim 1, wherein the support is symmetric.

13. An apparatus, comprising:

a shroud including a first shroud panel, a second shroud panel coupled to the first shroud panel, and an interior formed between the first shroud panel and the second shroud panel;

a support disposed in the interior of the shroud, the support including a top edge, a bottom edge, and first and second side edges, and the first side edge and the second side edge to extend through an aperture defined by the support, the first side edge includes a first tongue and a first stop and the second side edge includes a second tongue and a second stop; and a biasing member coupled to the support to cause a portion of the first shroud panel to separate from a portion of the second shroud panel, when the biasing member is coupled to the support, the biasing member surrounds the support engaging the top edge and the bottom edge.

14. The apparatus of claim 13, wherein the top and bottom edges define notches into which the biasing member is to be disposed.

15. The apparatus of claim 13, wherein the aperture is to receive the first and second tongues to couple the first and second side edges.

16. The apparatus of claim 13, wherein the support includes first and second support panels, the first support panel and the second support panel to be coupled to respective opposing shroud panels.

17. The apparatus of claim 16, further including a notch defined by the top edge or the bottom edge into which the biasing member is to be disposed, the notch positioned between the first support panel and the second support panel.

18. The apparatus of claim 13, wherein the interior has an oblong cross-section.

19. The apparatus of claim 13, wherein the biasing member is an elastic band.

20. The apparatus of claim 13, wherein the support is a first support, further including a second support disposed in the interior of the shroud spaced from the first support.

21. The apparatus of claim 13, wherein the first and second stops are to engage the support adjacent the aperture to restrict further movement of the first and second tongues through the aperture.

* * * * *